US010335923B2

(12) United States Patent
Kim et al.

(10) Patent No.: US 10,335,923 B2
(45) Date of Patent: Jul. 2, 2019

(54) CENTRIFUGAL BLADE LOCK AND RELEASE DEVICE FOR A BLAST WHEEL MACHINE

(71) Applicant: WHEELABRATOR GROUP, INC., Golden, CO (US)

(72) Inventors: Douglas J. Kim, Newnan, GA (US); Brian Keith Allardice, LaGrange, GA (US)

(73) Assignee: WHEELABRATOR GROUP, INC., Golden, CO (US)

( * ) Notice: Subject to any disclaimer, the term of this patent is extended or adjusted under 35 U.S.C. 154(b) by 0 days.

(21) Appl. No.: 15/684,187

(22) Filed: Aug. 23, 2017

(65) Prior Publication Data

US 2019/0061106 A1 Feb. 28, 2019

(51) Int. Cl.
*B24C 5/06* (2006.01)
*B24C 3/14* (2006.01)

(52) U.S. Cl.
CPC ..... *B24C 5/062* (2013.01); *B24C 3/14* (2013.01); *B24C 5/066* (2013.01)

(58) Field of Classification Search
CPC ..... B24C 5/068; B24C 5/06
USPC ..... 451/95, 96, 97, 98
See application file for complete search history.

(56) References Cited

U.S. PATENT DOCUMENTS 4,069,025 A * 1/1978 Macmillan ..... B24C 5/062 451/97
4,723,379 A 2/1988 Macmillan et al.
4,907,379 A 3/1990 MacMillan
4,908,998 A 3/1990 Watkin et al.
5,476,412 A 12/1995 Stoltz
5,577,953 A * 11/1996 MacMillan ..... B24C 5/062 415/115
5,759,091 A 6/1998 MacMillan
6,126,516 A 10/2000 Barrier et al.
6,764,390 B2 7/2004 Holloway et al.
(Continued)

FOREIGN PATENT DOCUMENTS

WO 2016039727 A1 3/2016
WO 2016048319 A1 3/2016
(Continued)

OTHER PUBLICATIONS

Notification of Transmittal of the International Search Report and the Written Opinion of the International Searching Authority from corresponding PCT/US2018/042621 dated Oct. 2, 2018.

*Primary Examiner* — Robert A Rose
(74) *Attorney, Agent, or Firm* — Lando & Anastasi, LLP

(57) ABSTRACT

A wheel assembly for a centrifugal blast wheel machine includes a blast wheel and several blades configured to throw blast media introduced into the blast wheel against a work piece. Each blade includes a first side having a first rail portion that extends along a length of the first side and a second side having a second rail portion that extends along a length of the second side. Each rail portion has a locking member positioned on an outside surface of the rail portion adjacent a first end of the blade. Each rail portion further has a contact surface that is configured to engage a surface of a seat of the blast wheel. Each blade further includes a positioning knob located on the first contact surface to prevent the blade from inadvertently being removed from the seat.

18 Claims, 5 Drawing Sheets

(56) References Cited

U.S. PATENT DOCUMENTS

| | | | |
|---|---|---|---|
| 6,949,014 | B2 | 9/2005 | Barrier et al. |
| 2017/0282331 | A1 | 10/2017 | Bitzel, Jr. et al. |

FOREIGN PATENT DOCUMENTS

| | | | |
|---|---|---|---|
| WO | 2017014767 | A1 | 1/2017 |
| WO | 2017061989 | A1 | 4/2017 |

* cited by examiner

CENTRIFUGAL BLADE LOCK AND RELEASE DEVICE FOR A BLAST WHEEL MACHINE

BACKGROUND OF THE DISCLOSURE

1. Field of the Disclosure

The present disclosure relates generally to abrasive blast wheels and methods for cleaning or treating surfaces of work pieces, and more particularly to a centrifugal blade for a blast wheel machine.

2. Discussion of Related Art

Centrifugal blast wheel machines generally include a rotatable wheel having a plate or a pair of spaced plates that carry radially extending blades. Particulate matter is discharged from a center of the blast wheel onto rotating surfaces of the blades, which propel the particulate matter against surfaces of a work piece to be cleaned or treated. Specifically, blast media is fed from a feed spout into a rotating impeller situated within a control cage at the center of the blast wheel. The media is fed from the impeller, though an opening in the control cage, and onto the heels or the inner ends of the rotating blades. The media travels along the faces of the blades and is thrown from the tips of the blades at the work piece surfaces to be treated.

From observation of the internal operation of blast wheels and through maintenance on the blast wheel, during installation the blade has a tendency to fall back, or requires a tool to prevent the blade from falling back, before the lock up of the blade is achieved. In addition, previous blade designs form a lock that is very difficult to overcome, and require excessive mechanical force to release them from their seat. The heat generated in the wheel housing can cause many rubbers to melt.

SUMMARY OF THE DISCLOSURE

One aspect of the present disclosure is directed to a centrifugal blast wheel machine comprising a wheel assembly including a blast wheel and a plurality of blades configured to throw blast media introduced into the blast wheel against a work piece. The centrifugal blast wheel further includes an impeller positioned about an axis of the blast wheel. The impeller has a media inlet at one end adapted to receive blast media and a plurality of impeller media outlets constructed and arranged to allow egress of blast media upon rotation of the impeller. The centrifugal blast wheel further includes a motor coupled to the impeller to drive the rotation of the impeller and the wheel assembly and a control cage surrounding the impeller and secured to the blast wheel. The control cage includes a cylindrical body defining an interior chamber. The cylindrical body has an opening formed therein to allow the egress of blast media from the interior chamber. Each blade includes a main body portion having a first side, a second side, and a first end. The first side includes a first rail portion that extends along a length of the first side. The first rail portion has a thickness greater than a thickness of the main body portion. The second side includes a second rail portion that extends along a length of the second side. The second rail portion has a thickness greater than a thickness of the main body portion. The first rail portion of the blade has a first locking member positioned on an outside surface of the first rail portion adjacent the first end of the main body portion of the blade. The second rail portion of the blade has a second locking member positioned on an outside surface of the second rail portion adjacent the first end of the main body portion of the blade. The first rail portion further has a first contact surface that is configured to engage a surface of a seat of the blast wheel. The second rail portion further has a second contact surface that is configured to engage another surface of the seat of the blast wheel. The blade further includes a positioning knob located on the first contact surface to prevent the blade from inadvertently being removed from the seat.

Embodiments of the centrifugal blast wheel machine further may include locating the knob approximately midway along a length of the first rail portion and along a centerline of the first rail portion. The knob may be fabricated from silicone and attached to the blade to provide a heat resistant friction that prevents the blade from moving relative to the seat of the blast wheel. The blast wheel may include a first plate and a second plate spaced from the first plate, with first plate having a first slot formed therein and the second plate having a mating second slot formed therein. The first and second slots may define the seat that is sized and configured to receive the first and second rail portions of the blade therein. The first slot may have a first engaging surface to engage a tapered surface of the first locking member, and the second slot may have a second engaging surface to engage a tapered surface of the second locking member. The blade may be movable with respect to the seat from an uninstalled position to an installed position. The arrangement is such that when in the uninstalled position the knob is positioned within the slot of the first rail portion so that the knob is spaced from a surface of the slot to enable the axial movement of the blade with respect to the blast wheel, and when in the installed position the knob engages the surface of the slot to provide a heat resistant friction that prevents the blade from backing out of the seat.

Another aspect of the present disclosure is directed to a wheel assembly for a centrifugal blast wheel machine. In one embodiment, the wheel assembly comprises a blast wheel and a plurality of blades coupled to the blast wheel and configured to throw blast media introduced into the blast wheel against a work piece. Each blade includes a main body portion having a first side, a second side, and a first end. The first side includes a first rail portion that extends along a length of the first side. The first rail portion has a thickness greater than a thickness of the main body portion. The second side includes a second rail portion that extends along a length of the second side. The second rail portion has a thickness greater than a thickness of the main body portion. The first rail portion of the blade has a first locking member positioned on an outside surface of the first rail portion adjacent the first end of the main body portion of the blade. The second rail portion of the blade has a second locking member positioned on an outside surface of the second rail portion adjacent the first end of the main body portion of the blade. The first rail portion further has a first contact surface that is configured to engage a surface of a seat of the blast wheel. The second rail portion further has a second contact surface that is configured to engage another surface of the seat of the blast wheel. The blade further includes a positioning knob located on the first contact surface to prevent the blade from inadvertently being removed from the seat.

Embodiments of the wheel assembly further may include locating the knob approximately midway along a length of the first rail portion and along a centerline of the first rail portion. The knob may be positioned within a recess formed in the first contact surface in which a portion of the knob extends slightly beyond the first contact surface. The knob may be fabricated from silicone and attached to the blade to provide a heat resistant friction that prevents the blade from moving relative to the seat of the blast wheel. The blast wheel includes a first plate and a second plate spaced from the first plate, with first plate having a first slot formed therein and the second plate having a mating second slot formed therein. The first and second slots may define the seat that is sized and configured to receive the first and second rail portions of the blade therein. The first slot may have a first engaging surface to engage a tapered surface of the first locking member, and the second slot has a second engaging surface to engage a tapered surface of the second locking member. The blade may be movable with respect to the seat from an uninstalled position to an installed position. The arrangement is such that when in the uninstalled position the knob is positioned within the slot of the first rail portion so that the knob is spaced from a surface of the slot to enable the axial movement of the blade with respect to the blast wheel, and when in the installed position the knob engages the surface of the slot to provide a heat resistant friction that prevents the blade from backing out of the seat.

Yet another aspect of the disclosure is directed to a method of operating a centrifugal blast wheel machine. In one embodiment, the method comprises: feeding blast media from a feed spout into an impeller of the centrifugal blast wheel machine; accelerating the blast media by rotating the impeller giving rise to a centrifugal force that moves the blast media in radial direction, away from an axis of the impeller; moving the blast media in a generally circular direction into a space between the impeller and a control cage; metering an amount of blast media through an opening of the control cage onto blades of a blast wheel; and moving the blast media along lengths of the blades to accelerate and throw the blast media toward a work piece. Each blade is maintained in an installed condition by a positioning knob associated with the blade.

Embodiments of the method further may include configuring each blade to include a main body portion having a first side, a second side, and a first end. The first side may include a first rail portion that extends along a length of the first side. The first rail portion may have a thickness greater than a thickness of the main body portion. The second side may include a second rail portion that extends along a length of the second side. The second rail portion may have a thickness greater than a thickness of the main body portion. The first rail portion of the blade may have a first locking member positioned on an outside surface of the first rail portion adjacent the first end of the main body portion of the blade. The second rail portion of the blade may have a second locking member positioned on an outside surface of the second rail portion adjacent the first end of the main body portion of the blade. The first rail portion further may have a first contact surface that is configured to engage a surface of a seat of the blast wheel. The second rail portion further may have a second contact surface that is configured to engage another surface of the seat of the blast wheel. The blade further may include a positioning knob located on the first contact surface to prevent the blade from inadvertently being removed from the seat. The knob may be located approximately midway along a length of the first rail portion and along a centerline of the first rail portion. The knob may be fabricated from silicone and attached to the blade to provide a heat resistant friction that prevents the blade from moving relative to the seat of the blast wheel. The blast wheel may include a first plate and a second plate spaced from the first plate, with first plate having a first slot formed therein and the second plate having a mating second slot formed therein. The first and second slots may define the seat that is sized and configured to receive the first and second rail portions of the blade therein. The first slot may have a first engaging surface to engage a tapered surface of the first locking member, and the second slot may have a second engaging surface to engage a tapered surface of the second locking member. The blade may be movable with respect to the seat from an uninstalled position to an installed position. The arrangement is such that when in the uninstalled position the knob is positioned within the slot of the first rail portion so that the knob is spaced from a surface of the slot to enable the axial movement of the blade with respect to the blast wheel, and when in the installed position the knob engages the surface of the slot to provide a heat resistant friction that prevents the blade from backing out of the seat.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

The blast wheel of embodiments of the present disclosure is designed to throw metallic shot, grit, cut wire, etc., which together may be referred to as "abrasive," "abrasive blast media," "abrasive media," "blast media," "media" or any suitable description of particulate matter. The blast wheel machine typically consists of four primary components that act in conjunction to throw the media at a target object to be cleaned, peened or otherwise have its surface prepared. An impeller acts to accelerate the abrasive media once the media is fed into a wheel assembly. The impeller rotates within the interior of a control cage, which may also be referred to as an "impeller case." The control cage acts to meter the abrasive blast media flow through an opening formed in the control cage to direct the flow of media onto rotating blades by adjusting the position of the opening. The control cage is stationary within the blast wheel under operating conditions. The blades (generally from two to twelve in number) rotate outside of the control cage and propel the abrasive blast media along their radial length toward the target. A bare wheel, which may also be referred to as a "runner head" or simply as a "wheel," holds the impeller and blades, and typically rotates the impeller and blades between 1500-3600 revolutions per minute (rpm) by way of a power source, which in one embodiment is an electric motor.

Embodiments of the present disclosure are directed to a new blade design that prevents the throwing blade from backing out of a locking position before a plate that locks the blade in place is inserted, but still allows the friction locking to be overcome by hand force. The blade configuration increases efficiency in the maintenance of the blast wheel by way of not needing special tools for holding the blades in place, and to limit the force required to remove the blade by minimizing the engagement between the blade and its seating surface.

Figure 1:
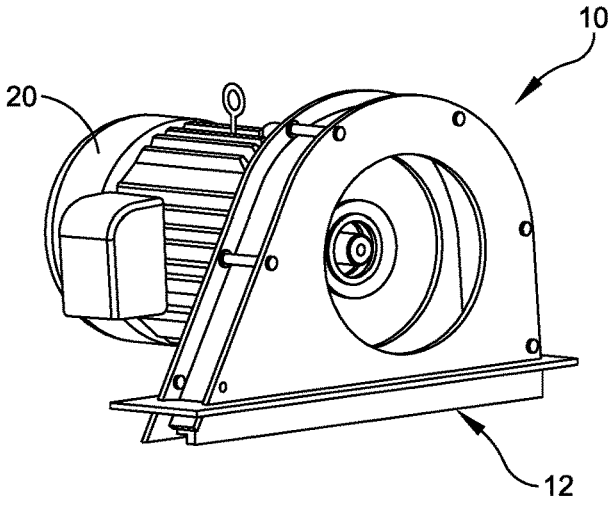
FIG. 1 is a perspective view of a portion of a centrifugal blast wheel machine.
Figure 2:
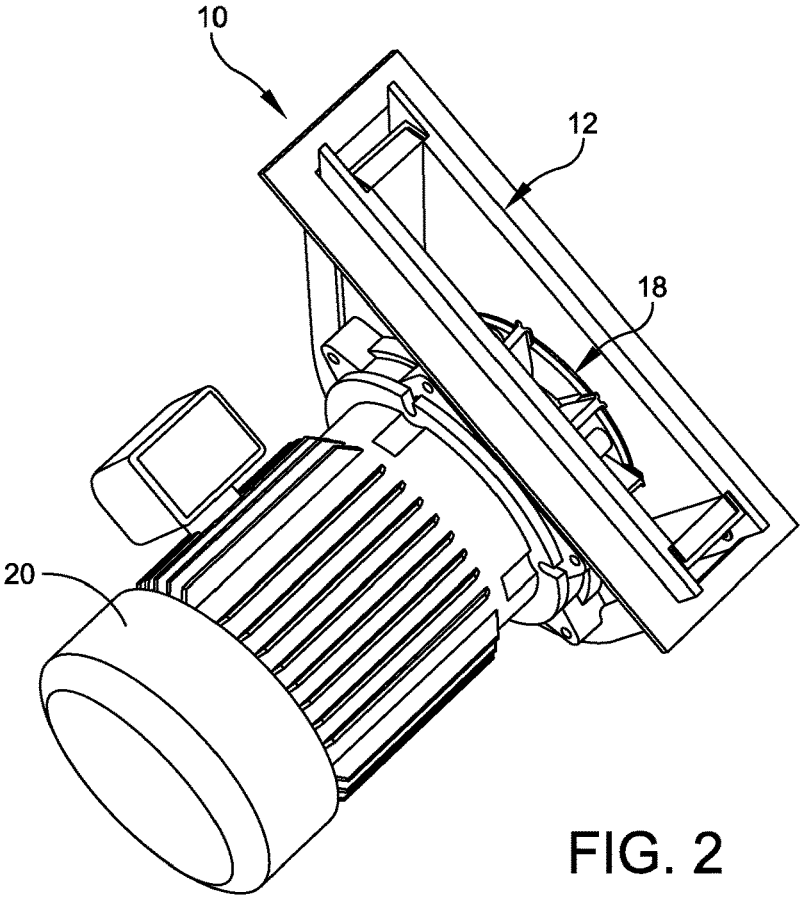
FIG. 2 is another perspective view of the centrifugal blast wheel machine.
Figure 3:
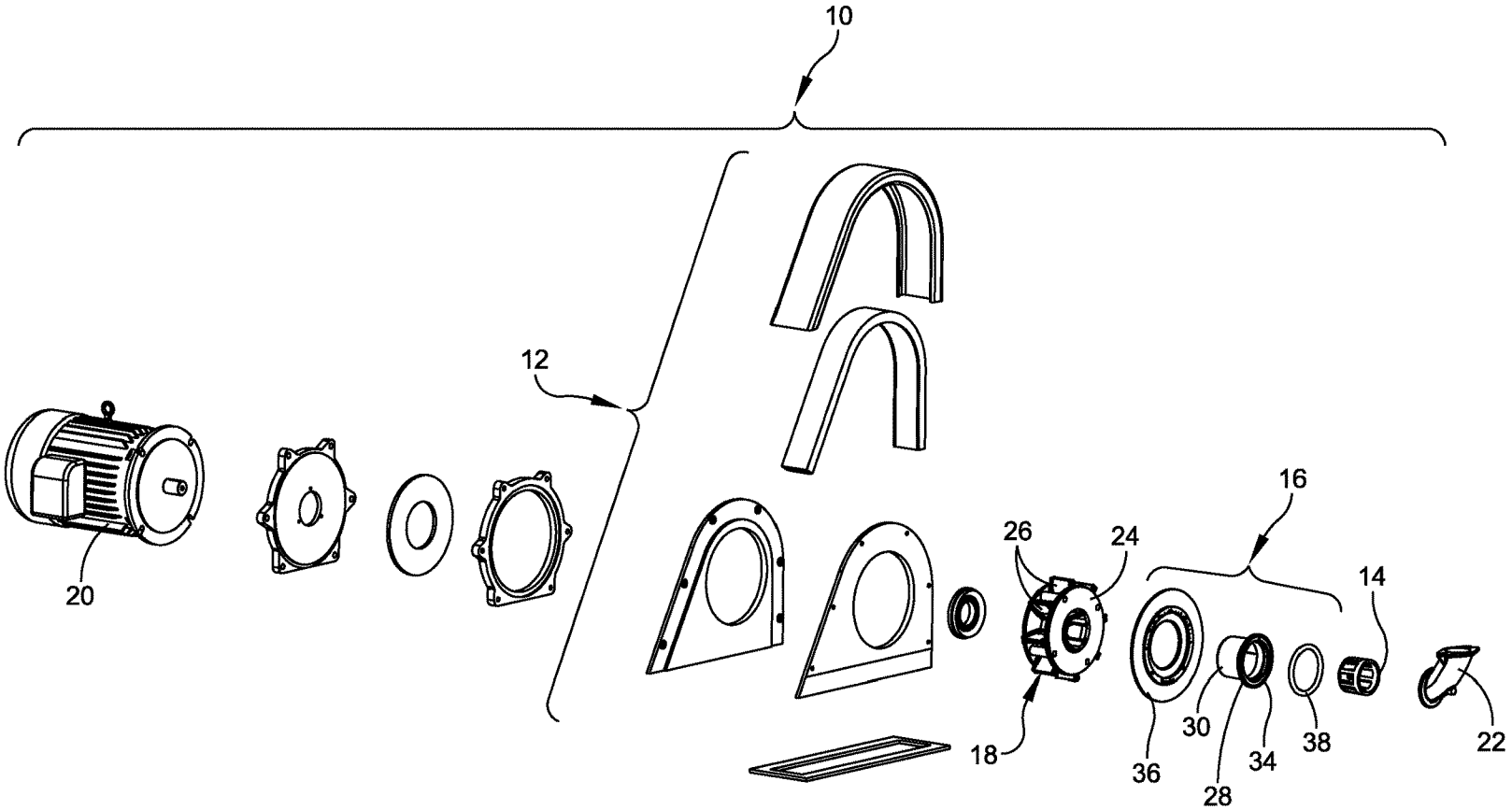
FIG. 3 is an exploded perspective view of the centrifugal blast wheel machine.

Referring to the drawings, and more particularly to FIGS. 1-3, a centrifugal blast wheel machine is generally indicated at 10. In one embodiment, the centrifugal blast wheel machine 10 includes a housing, generally indicated at 12, which is designed to house the components of the centrifugal blast wheel machine. The centrifugal blast wheel machine 10 further includes a rotating impeller 14 supported by a drive shaft, a control cage assembly, generally indicated at 16, which surrounds the impeller, and a blast wheel assembly, generally indicated at 18, which receives the control cage assembly. A motor 20 is provided to drive the rotation of the impeller 14 and the blast wheel assembly 18. The arrangement is such that blast media is fed from a feed spout 22 into the rotating impeller 14, which is driven by the motor 20. By contact with vanes of the rotating impeller 14 (as well as with other particles of media already in the impeller), blast media particles are accelerated, giving rise to a centrifugal force that moves the particles in radial direction, away from the axis of the impeller. The blast media particles, now moving in a generally circular direction as well as outwards, move through openings formed in the impeller 14 into a space between the impeller and a control cage of the control cage assembly 16, still being carried by the movement of the impeller vanes (also known as impeller dams) and the other particles.

When the blast media particles that have passed though the impeller openings into the space between the impeller 14 and the control cage assembly 16 reach an opening provided in the control cage assembly, rotational and centrifugal forces move the particles through the opening. The control cage assembly 16 functions to meter a consistent and appropriate amount of blast media onto the blades of the blast wheel assembly 18. As the vanes of the impeller 14 rotate, the blast media particles are moved along their lengths and accelerate until they reach the ends of the vanes and thrown from the ends of the vanes. Although the impeller 14 is shown to be cylindrical in shape, the size and thickness of the impeller may vary depending on the size of a blast wheel assembly and the desired performance characteristics. For example, the impeller 14 may have interior or exterior walls that taper in either direction along its axis. Typically, the impeller will be made of a ferrous material, such as cast or machined iron or steel, although other materials may also be appropriate. In one particular embodiment, the impeller is formed of cast white iron.

The blast wheel assembly 18 of the centrifugal blast wheel machine 10 includes a hub or wheel 24 and a plurality of blades, each generally indicated at 26, to throw blast media introduced into the wheel assembly to treat the work piece contained within the housing 12. The arrangement is such that the impeller 14 is positioned about an axis of the wheel 24 of the blast wheel assembly 18, with the impeller having a media inlet at one end adapted to receive blast media and a plurality of impeller media outlets constructed and arranged to allow egress of blast media upon rotation of the impeller. The control cage of the control cage assembly 16 surrounds the impeller 14 in a position in which the media outlet of the control cage assembly is adapted for passage of blast media to the heel ends of the blades of the blast wheel assembly 18. As mentioned above, the motor 20 is coupled to the impeller 14 and to the blast wheel assembly 18 to drive the rotation of the impeller and the wheel assembly.

In one embodiment, the control cage assembly 16 includes a control cage 28 having a cylindrical wall 30 forming a housing defining an interior chamber and a media outlet or opening 32 formed in the cylindrical wall for allowing the egress of blast media from the interior chamber. A typical centrifugal blast wheel machine 10 having the control cage 28 is used to treat a surface (not shown) of a work piece by projecting blast media (not shown) at the surface. The treatment may be in the nature of cleaning, peening, abrading, eroding, de-burring, de-flashing, and the like, and the blast media typically consists of solid particles such as shot, grit, segments of wire, sodium bicarbonate, or other abrasives, depending on the surface being treated and/or the material being removed from the surface.

The control cage 28 of the control cage assembly 16, typically formed of cast iron (or similar material), is positioned concentrically around impeller 14 and, is approximately cylindrical in shape. Like the impeller 14, however, the control cage 28 may have other shapes, and may, for example, taper internally and/or externally in either direction along its axis. The control cage 28 also includes an outer flange or locking ring 34, which mates with an adaptor plate 36, which in turn is mounted on the wheel 24 of the blast wheel assembly 18, fixing the control cage with respect to the wheel and preventing the control cage from rotating with respect to the wheel upon operation of the blast wheel assembly 10. A retaining ring 38 is further provided to firmly secure the locking ring 34 and to prevent the rotational movement of the control cage 28 with respect to the adaptor plate 36 after securing the adaptor plate to the blast wheel 24 of the blast wheel assembly 18. The control cage 28 is then locked in place by placing the feed spout 22 onto the control cage and by firmly securing a feed spout bracket.

In other embodiments, the control cage 28 may be restrained from movement by attachment to other stationary elements of the blast wheel assembly 18 or its environment (as indicated above), or, in some cases, may be allowed to or made to rotate in one or both directions. As shown, one of two retaining rings 38 may be provided, with one of the retaining rings having markings or other indicia that allow a user to position the control cage 28 in a certain desired rotational orientation, so as to control the direction of the media being thrown by the blast wheel assembly 18.

As mentioned above, the media opening 32 of the control cage 28 allows egress of blast media upon operation of the blast wheel assembly 18. In one embodiment, the media opening 32 of the control cage 28 is approximately rectangular in shape when viewed from the side (i.e., in a direction perpendicular to its axis) and is approximately ⅗ the height of the cylindrical wall 30 of the control cage 28. The size, shape, and location of the media opening 32 may vary depending on the application, however. The length of the media opening 32 is measured in degrees, from the innermost portion of the opening furthest ahead in the direction of rotation to the outermost edge of the trailing portion. While the media opening 32 of the shown embodiment is approximately seventy degrees for a wheel rotating in either direction, in other embodiments, the length of the opening (in either direction) may vary, depending numerous factors such as the overall size of the blast wheel assembly 18, the nature of the media being thrown, and the desired rate of flow, as would be understood by one of skill in the art.

The blast wheel assembly 18, which is arranged concentrically around control cage 28, includes the plurality of blades 26 sandwiched between a rear plate and a front plate of the wheel 24 of the wheel assembly. The various parts of blast wheel assembly 18 are typically formed of cast iron, although they may also be made of any other appropriate material and/or method. The blast wheel assembly 18 is connected to the motor 20, in this embodiment by means of key inserted to lock a shaft of motor to the rear wheel of the wheel assembly, so that wheel assembly may be rotated by motor during operation of the blast wheel assembly. The blades 26, which will be described in greater detail below with respect to FIGS. 4-6, each have a heel end and a tip, and are constructed and arranged to direct the blast media at the surface being treated. The blades 26 may be of any suitable size and any suitable shape, including one or more of straight, curved, flared, flat, concave, or convex shapes.

In one embodiment, the blades 26 may embody semi-curved blades, each blade having a curved portion positioned adjacent a central hub of the wheel assembly 18, and a straight portion integrally formed with the curved portion extending radially outwardly from the wheel assembly.

The operation of the centrifugal blast wheel machine 10 is as follows. The blast media is fed from the feed spout 22 into the rotating impeller 14. By contact with the rotating impeller vanes (as well as with other particles of media already in the impeller 14), the blast media particles are accelerated, giving rise to a centrifugal force that moves the particles in radial direction, away from the axis of the impeller. The blast media particles, now moving in a generally circular direction as well as outwards, move through the impeller openings into the space between the impeller 14 and the control cage 28, still being carried by the movement of the impeller vanes 42 and the other particles.

When the blast media particles that have passed though the impeller openings into the space between the impeller 14 and the control cage 28 to the media opening 32, the rotational and centrifugal forces move the particles through the media opening and onto the heel ends of the blades 26. The control cage 28 functions to meter a consistent and appropriate amount of blast media onto the blades 26. As the blades 26 of the blast wheel 24 rotate, the blast media particles are moved along their lengths and accelerate until they reach the tips, at which point they are thrown from the ends of the blades toward the work piece.

Figure 4:
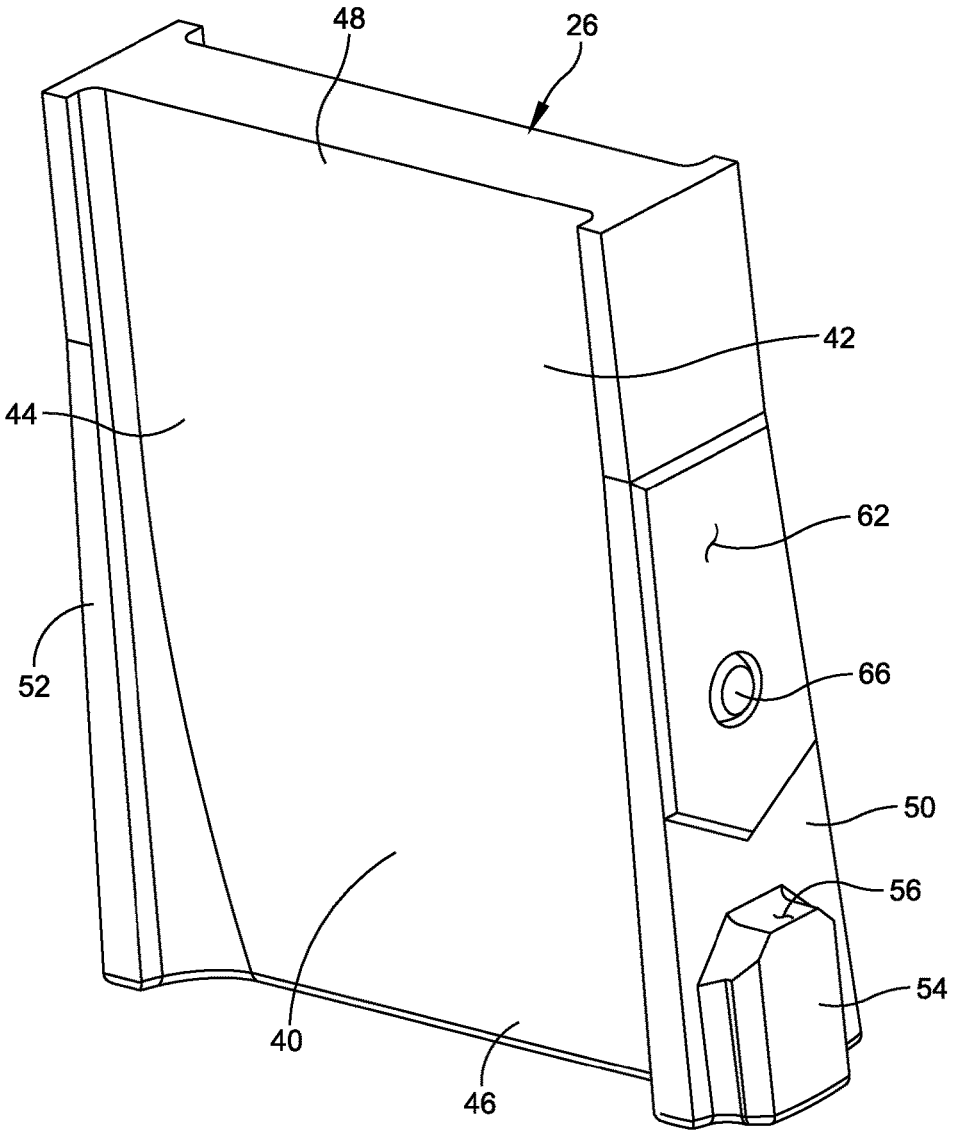
FIG. 4 is a perspective view of a blade of an embodiment of the present disclosure.

Referring to FIG. 4, a blade 26 of an embodiment of the present disclosure is shown. The blade 26 includes a main body portion 40 having a first side 42, a second side 44, a first inner end 46 and a second outer end 48. As shown, the first side 42 includes a first rail portion 50 that extends along a length of the first side, the first rail portion having a thickness (or width as viewed from the first side of the main body portion 40 of the blade 26) greater than a thickness of the main body portion. Similarly, the second side 44 includes a second rail portion 52 that extends along a length of the second side, the second rail portion having a thickness (or width as viewed from the second side of the main body portion 40 of the blade 26) greater than a thickness of the main body portion. As best shown in FIG. 4, the first and second rail portions 50, 52 are each slightly tapered, with a thickness adjacent the first inner end 46 of the main body portion 40 of the blade 26 being slightly greater than a thickness adjacent the second outer end 48. In some embodiments, the first inner end 46 can be referred to as the heel end and the second outer end 48 as the tip end. The main body portion 40 of the blade 26 may be of any suitable size and any suitable shape, including one or more of straight, curved, flared, flat, concave, or convex shapes.

As shown best in FIG. 4, the first rail portion 50 of the blade 26 is configured with a first locking member 54 positioned on an outside surface of the first rail portion adjacent the first inner end 46 of the main body portion 40 of the blade. The first locking member 54 extends outwardly with respect to the outside surface of the first rail portion 50 to increase an overall width of the blade 26 (as viewed from facing the main body portion 40 of the blade). The first locking member 54 includes a first tapered surface 56 that enables an easier release from a seat associated with the blast wheel 24, which will be described in greater detail with reference to FIGS. 5 and 6.

Figure 5:
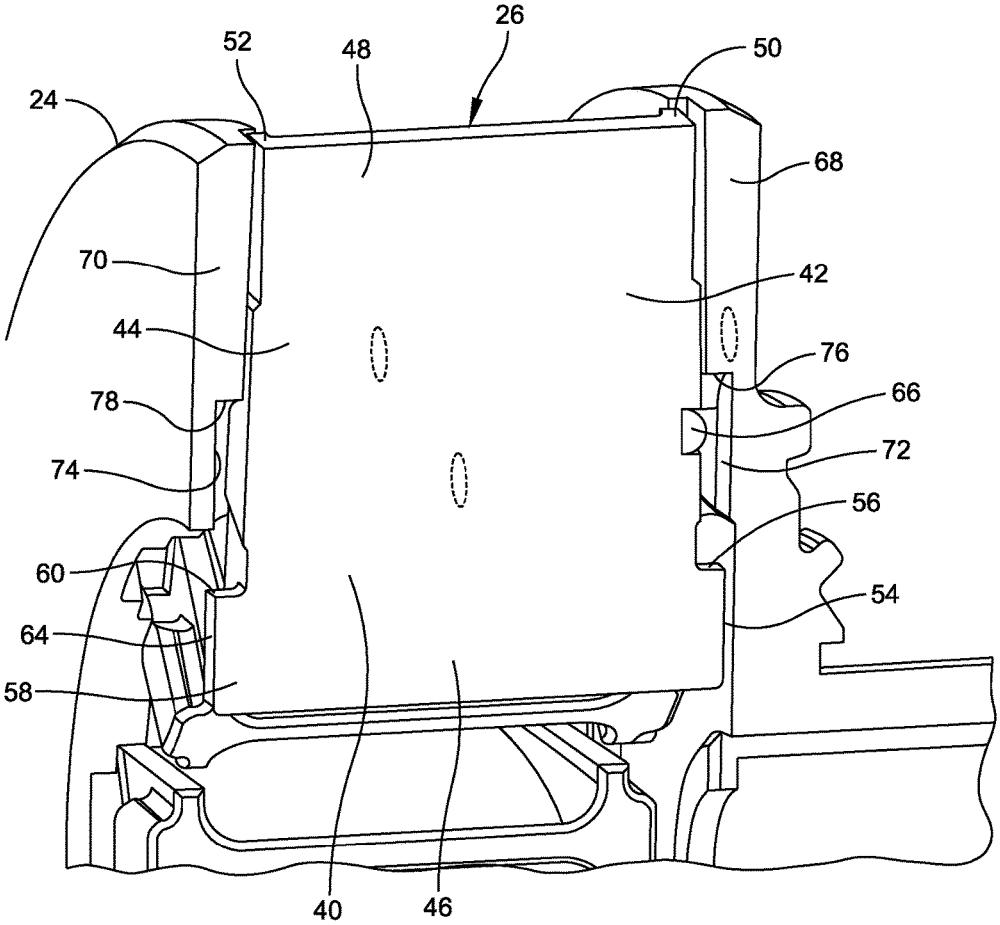
FIG. 5 is a cross-sectional perspective view of the blade partially installed within a blast wheel of the blast wheel machine.

Similarly, with additional reference to FIG. 5, the second rail portion 52 of the blade 26 is configured with a second locking member 58 positioned on an outside surface of the second rail portion adjacent the first inner end 46 of the main body portion 40 of the blade. The second locking member 58 extends outwardly with respect to the outside surface of the second rail portion 52 to increase an overall width of the blade 26 (as viewed from facing the main body portion 40 of the blade). The second locking member 58 includes a second tapered surface 60 that enables an easier release from the seat associated with the blast wheel 24.

The first rail portion 50 further includes a first contact surface 62 that is configured to engage a surface of a seat of the blast wheel 24. Similarly, the second rail portion 52 further includes a second contact surface 64 that is configured to engage another surface of the seat of the blast wheel 24. When fully installed, the first contact surface 62 and the second contact surface 64 frictionally engage the seat of the blast wheel 24 in a manner described in greater detail below.

Still referring to FIG. 4, the first rail portion 50 of the blade further includes a positioning knob 66 located on the first contact surface 62 approximately midway along a length of the first rail portion and along a centerline of the first rail portion. As shown, the knob 66 is positioned within a recess formed in the first contact surface 62 in which a portion of the knob extends slightly beyond the first contact surface. In the art of wheel blast machines, blades can fall out as they are inserted into respective seats and then rotated to a point where gravity causes the blade to fall back and injure hands and fingers. When tooling is used to hold blades in place, the provision of tooling adds a certain level of complexity to the operation and slows the pace of the wheel blast machine. When it is time to remove the blades, severe impact with a rubber mallet is often needed to remove the each blade from its respective seat. In one embodiment, the knob (or bumper) 66 is fabricated from silicone and attached to the cast blade 26 to provide a heat resistant friction that stops the blade from coming back in its seat and falling loose when turned to the upper positions without a locking plate in place. A friction provided by the knob 66 can be overcome by hand, in order for the blade 26 to be removed and replaced and or reinserted.

Referring to FIG. 5, the blade 26 is shown in a pre-installed or partially installed position. As shown, the blast wheel 24 includes two spaced-apart plates 68, 70, with the first plate 68 having a first slot 72 formed therein and the second plate 70 having a mating second slot 74 formed therein. Together, the first and second slots 72, 74 define a seat that is sized and configured to receive the blade 26 therein. The first slot 72 has a first engaging surface 76 to engage the first tapered surface 56 of the first locking member 54. Similarly, the second slot 74 has a second engaging surface 78 to engage the second tapered surface 60 of the second locking member 58. The arrangement is such that the first rail portion 50 is received in the first slot 72 and the second rail portion 52 is received in the second slot 74, with the blade 26 being inserted within the seat from open central portions of the plates 68, 70 of the blast wheel 24. In FIG. 5, the first tapered surface 56 of the first locking member 54 and the second tapered surface 60 of the second locking member 58 are spaced from their respective first engaging surface 76 of the first slot 72 and the second engaging surface 78 of the second slot 74.

As shown, the knob 66 is positioned within the first slot 72 of the first rail portion 50 so that the knob is spaced from an inner surface of the first slot to enable the axial movement of the blade 26 with respect to the blast wheel 24.

Figure 6:
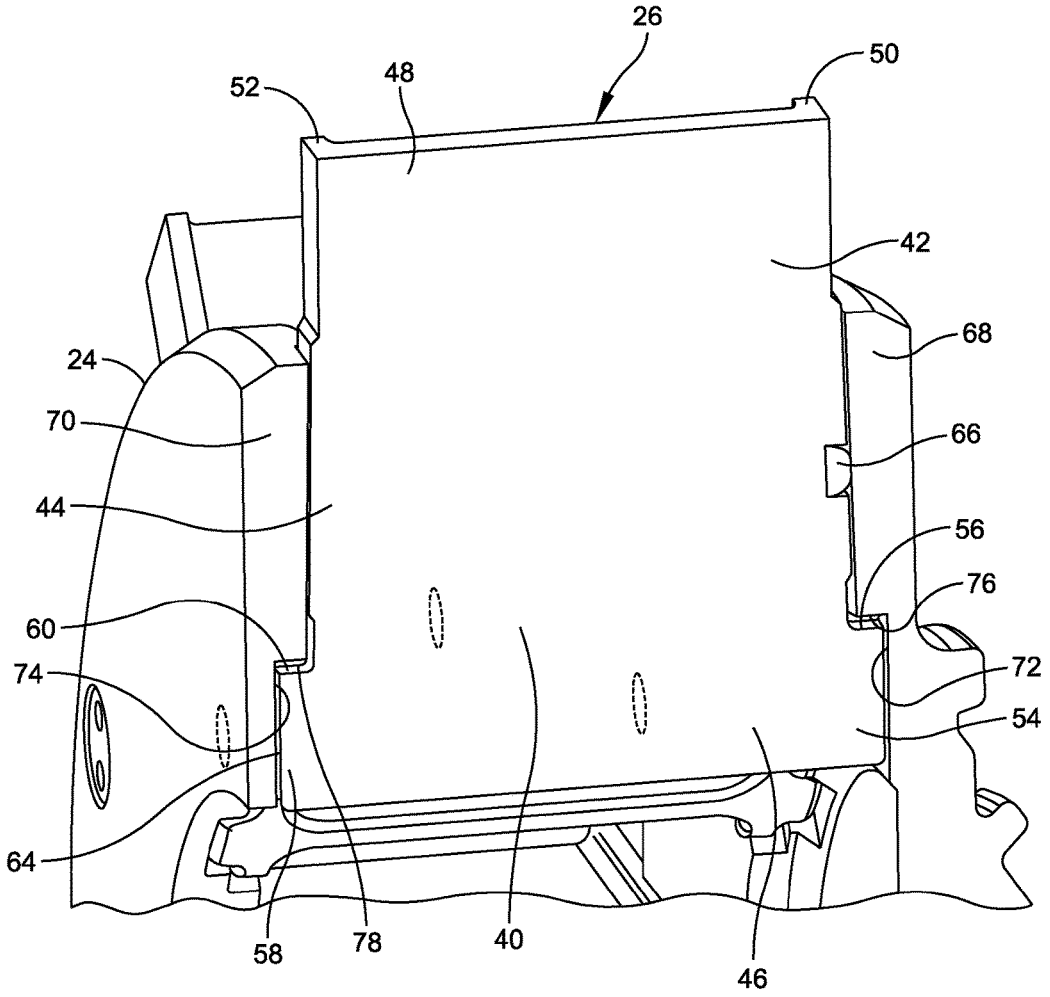
FIG. 6 is a cross-sectional perspective view of the blade fully installed within the blast wheel of the blast wheel machine.

Referring to FIG. 6, the blade 26 is shown in an installed position. As shown, the blade 26 is fully inserted into the seat of the blast wheel 24 so that the first and second locking members 54, 58 are completely received within their respective first and second slots 72, 74 of the blast wheel. Specifically, the first tapered surface 56 of the first locking member 54 engages the first engaging surface 76 provided in the first slot 72 and the second tapered surface 60 of the second locking member 58 engages the second engaging surface 78 provided in the second slot 74. The first and second tapered surfaces 56, 60 of the first and second locking members 54, 58, respectively, enable easier release of the locking members from their respective slots.

As shown, the knob 66 engages the inner surface of the first slot 72 to provide a heat resistant friction that stops the blade 26 from coming back in its seat and falling loose when turned to the upper positions without a locking plate in place.

Thus, it should be observed that the blade design of the present disclosure prevents the centrifugal throwing blade from backing out of the locking position before the locking plate that locks the blade in place is inserted. In addition, the reconfigured throwing blade with the knob and wheel seat enables friction locking of the blade and the blast wheel to be overcome by hand force. The blade is easy to maintain by maintenance staff. The ability to place all blades into the housing without tooling saves time. Further, the ability to remove the blade by overcoming the friction of the silicone bumper also reduces the time required, as tools such as rubber mallets to force the blade back in its seat for removal are not the normal requirement.

In certain embodiments, the blade attachment method could be applied across the industry and by mimicking the compression of the silicone knob be reproduced for any blade type. The blades are easier to install as they require no tooling and do not fall out when inverted during the installation process, further the combination of the friction created by the knob which allows the locking surfaces to be reduced, allows the blade to be freed easier from its seat.

Having thus described several aspects of at least one embodiment of this disclosure, it is to be appreciated various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

What is claimed is:

1. A centrifugal blast wheel machine comprising:

a wheel assembly including a blast wheel and a plurality of blades configured to throw blast media introduced into the blast wheel against a work piece;

an impeller positioned about an axis of the blast wheel, the impeller having a media inlet at one end adapted to receive blast media and a plurality of impeller media outlets constructed and arranged to allow egress of blast media upon rotation of the impeller;

a motor coupled to the impeller to drive the rotation of the impeller and the wheel assembly; and a control cage surrounding the impeller and secured to the blast wheel, the control cage including a cylindrical body defining an interior chamber, the cylindrical body having an opening formed therein to allow the egress of blast media from the interior chamber, wherein each blade includes a main body portion having a first side, a second side, and a first end, the first side including a first rail portion that extends along a length of the first side, the first rail portion having a thickness greater than a thickness of the main body portion, the second side including a second rail portion that extends along a length of the second side, the second rail portion having a thickness greater than a thickness of the main body portion, the first rail portion of the blade having a first locking member positioned on an outside surface of the first rail portion adjacent the first end of the main body portion of the blade, the second rail portion of the blade having a second locking member positioned on an outside surface of the second rail portion adjacent the first end of the main body portion of the blade, the first rail portion further having a first raised contact surface that is configured to engage a surface of a seat of the blast wheel, the first raised contact surface extending beyond a surface of the first rail portion, the second rail portion further having a second raised contact surface that is configured to engage another surface of the seat of the blast wheel, the second raised contact surface extending beyond a surface of the second rail portion, the blade further including a positioning knob located on the first raised contact surface to prevent the blade from inadvertently being removed from the seat, the knob being positioned within a recess formed in the first raised contact surface in which a portion of the knob extends slightly beyond the first raised contact surface.

2. The centrifugal blast wheel machine of claim 1, wherein the knob is located approximately midway along a length of the first rail portion and along a centerline of the first rail portion.

3. The centrifugal blast wheel machine of claim 1, wherein the knob is fabricated from silicone and attached to the blade to provide a heat resistant friction that prevents the blade from moving relative to the seat of the blast wheel.

4. The centrifugal blast wheel machine of claim 1, wherein the blast wheel includes a first plate and a second plate spaced from the first plate, with first plate having a first slot formed therein and the second plate having a mating second slot formed therein, the first and second slots defining the seat that is sized and configured to receive the first and second rail portions of the blade therein.

5. The centrifugal blast wheel machine of claim 4, wherein the first slot has a first engaging surface to engage a tapered surface of the first locking member, and the second slot has a second engaging surface to engage a tapered surface of the second locking member.

6. The centrifugal blast wheel machine of claim 5, wherein the blade is movable with respect to the seat from an uninstalled position to an installed position, the arrangement being such that when in the uninstalled position the knob is positioned within the slot of the first rail portion so that the knob is spaced from a surface of the slot to enable the axial movement of the blade with respect to the blast wheel, and when in the installed position the knob engages the surface of the slot to provide a heat resistant friction that prevents the blade from backing out of the seat.

7. A wheel assembly for a centrifugal blast wheel machine, the wheel assembly comprising:

a blast wheel; and a plurality of blades coupled to the blast wheel and configured to throw blast media introduced into the blast wheel against a work piece, wherein each blade includes a main body portion having a first side, a second side, and a first end, the first side including a first rail portion that extends along a length of the first side, the first rail portion having a thickness greater than a thickness of the main body portion, the second side including a second rail portion that extends along a length of the second side, the second rail portion having a thickness greater than a thickness of the main body portion, the first rail portion of the blade having a first locking member positioned on an outside surface of the first rail portion adjacent the first end of the main body portion of the blade, the second rail portion of the blade having a second locking member positioned on an outside surface of the second rail portion adjacent the first end of the main body portion of the blade, the first rail portion further having a first raised contact surface that is configured to engage a surface of a seat of the blast wheel, the first raised contact surface extending beyond a surface of the first rail portion, the second rail portion further having a second raised contact surface that is configured to engage another surface of the seat of the blast wheel, the second raised contact surface extending beyond a surface of the second rail portion, the blade further including a positioning knob located on the first raised contact surface to prevent the blade from inadvertently being removed from the seat, the knob being positioned within a recess formed in the first raised contact surface in which a portion of the knob extends slightly beyond the first raised contact surface.

8. The wheel assembly of claim 7, wherein the knob is located approximately midway along a length of the first rail portion and along a centerline of the first rail portion.

9. The wheel assembly of claim 7, wherein the knob is fabricated from silicone and attached to the blade to provide a heat resistant friction that prevents the blade from moving relative to the seat of the blast wheel.

10. The wheel assembly of claim 7, wherein the blast wheel includes a first plate and a second plate spaced from the first plate, with first plate having a first slot formed therein and the second plate having a mating second slot formed therein, the first and second slots defining the seat that is sized and configured to receive the first and second rail portions of the blade therein.

11. The wheel assembly of claim 10, wherein the first slot has a first engaging surface to engage a tapered surface of the first locking member, and the second slot has a second engaging surface to engage a tapered surface of the second locking member.

12. The wheel assembly of claim 11, wherein the blade is movable with respect to the seat from an uninstalled position to an installed position, the arrangement being such that when in the uninstalled position the knob is positioned within the slot of the first rail portion so that the knob is spaced from a surface of the slot to enable the axial movement of the blade with respect to the blast wheel, and when in the installed position the knob engages the surface of the slot to provide a heat resistant friction that prevents the blade from backing out of the seat.

13. A method of operating a centrifugal blast wheel machine, the method comprising:

feeding blast media from a feed spout into an impeller of the centrifugal blast wheel machine;

accelerating the blast media by rotating the impeller giving rise to a centrifugal force that moves the blast media in radial direction, away from an axis of the impeller;

moving the blast media in a generally circular direction into a space between the impeller and a control cage;

metering an amount of blast media through an opening of the control cage onto blades of a blast wheel; and moving the blast media along lengths of the blades to accelerate and throw the blast media toward a work piece, wherein each blade is maintained in an installed condition by a positioning knob associated with the blade, wherein each blade includes a main body portion having a first side, a second side, and a first end, the first side including a first rail portion that extends along a length of the first side, the first rail portion having a thickness greater than a thickness of the main body portion, the second side including a second rail portion that extends along a length of the second side, the second rail portion having a thickness greater than a thickness of the main body portion, the first rail portion of the blade having a first locking member positioned on an outside surface of the first rail portion adjacent the first end of the main body portion of the blade, the second rail portion of the blade having a second locking member positioned on an outside surface of the second rail portion adjacent the first end of the main body portion of the blade, the first rail portion further having a first raised contact surface that is configured to engage a surface of a seat of the blast wheel, the first raised contact surface extending beyond a surface of the first rail portion, the second rail portion further having a second raised contact surface that is configured to engage another surface of the seat of the blast wheel, the second raised contact surface extending beyond a surface of the second rail portion, the blade further including a positioning knob located on the first raised contact surface to prevent the blade from inadvertently being removed from the seat, the knob being positioned within a recess formed in the first raised contact surface in which a portion of the knob extends slightly beyond the first raised contact surface.

14. The method of claim 13, wherein the knob is located approximately midway along a length of the first rail portion and along a centerline of the first rail portion.

15. The method of claim 13, wherein the knob is fabricated from silicone and attached to the blade to provide a heat resistant friction that prevents the blade from moving relative to the seat of the blast wheel.

16. The method of claim 13, wherein the blast wheel includes a first plate and a second plate spaced from the first plate, with first plate having a first slot formed therein and the second plate having a mating second slot formed therein, the first and second slots defining the seat that is sized and configured to receive the first and second rail portions of the blade therein.

17. The method of claim 16, wherein the first slot has a first engaging surface to engage a tapered surface of the first locking member, and the second slot has a second engaging surface to engage a tapered surface of the second locking member.

18. The method of claim 17, wherein the blade is movable with respect to the seat from an uninstalled position to an installed position, the arrangement being such that when in the uninstalled position the knob is positioned within the slot of the first rail portion so that the knob is spaced from a surface of the slot to enable the axial movement of the blade with respect to the blast wheel, and when in the installed position the knob engages the surface of the slot to provide a heat resistant friction that prevents the blade from backing out of the seat.

* * * * *